US007793476B2

(12) United States Patent
Sanders et al.

(10) Patent No.: US 7,793,476 B2
(45) Date of Patent: Sep. 14, 2010

(54) NON-TOP SUPPORTED FENCE INSTALLATION BRACKET

(76) Inventors: Steven H. Sanders, 4180 Douglas Blvd., Suite 100, Granite Bay, CA (US) 95746; Thomas R. Sell, 4508 Beechwood Dr., El Dorado Hills, CA (US) 95762; Andrew J. Cowan, 1301 Ulfinian Way, Martinez, CA (US) 94553

( * ) Notice: Subject to any disclaimer, the term of this patent is extended or adjusted under 35 U.S.C. 154(b) by 191 days.

(21) Appl. No.: 11/974,497

(22) Filed: Oct. 12, 2007

(65) Prior Publication Data

US 2009/0094931 A1 Apr. 16, 2009

(51) Int. Cl.
*E04B 1/41* (2006.01)
*E04B 1/38* (2006.01)

(52) U.S. Cl. ..... 52/296; 52/92.2; 52/713; 52/745.1; 256/65.14

(58) Field of Classification Search ..... 52/7, 52/93.2, 98, 170, 169.13, 172–174, 188.91, 52/231.91, 235, 237, 239, 256, 280, 293.3, 52/295–299, 357, 365, 370, 519, 637–638, 52/645, 665, 690, 698, 701, 704–707, 712–715, 52/726, 731.6, 736.4, 737.3, 737.5, 737.6, 52/846, 92.2, 745.09, 745.1, 677; 211/148, 211/182; 403/173, 175; 405/258, 259, 259.5, 405/262, 272, 275, 284, 285, 286, 287, 287.1; 522/35; 182/78; 248/200, 300; 256/65.14
See application file for complete search history.

(56) References Cited

U.S. PATENT DOCUMENTS 914,867 A * 3/1909 Oliphant ..... 52/295
1,385,765 A * 7/1921 Wells ..... 52/707
1,589,356 A * 6/1926 Brooks ..... 52/370
2,467,115 A * 4/1949 Duggan ..... 52/699
3,000,145 A * 9/1961 Fine ..... 52/699
3,204,373 A * 9/1965 Small ..... 52/92.2
3,422,585 A * 1/1969 Dismukes ..... 52/127.3
3,889,441 A * 6/1975 Fortine ..... 52/715
4,329,826 A * 5/1982 Flogaus et al. ..... 52/712
4,387,543 A * 6/1983 Tschan et al. ..... 52/295
4,422,279 A * 12/1983 Powell ..... 52/745.12
4,524,553 A * 6/1985 Hacker ..... 52/169.11
4,739,598 A * 4/1988 Jensen et al. ..... 52/295
4,793,110 A * 12/1988 Tucker ..... 52/297
4,924,648 A * 5/1990 Gilb et al. ..... 52/295
4,995,206 A * 2/1991 Colonias et al. ..... 522/97
5,042,219 A * 8/1991 Fricker ..... 52/707

(Continued)

*Primary Examiner*—Robert J Canfield
(74) *Attorney, Agent, or Firm*—James E. Parris

(57) ABSTRACT

A non-top-supported column attachment bracket assembly is provided, that includes a generally W-shaped bracket to provide a strong connection between non-top supported wood fences and masonry walls such as concrete masonry unit (CMU) walls or cast in place (CIP) walls. The W-shape provides a matrix inside the hardening structure of the wall, while simultaneously engaging the horizontal reinforcing bar of the wall. The W-anchor further includes a cover plate disposed onto the bracket. The W-shaped bracket can be installed to the upper portion of the wall just prior to grouting or during grouting, where the bracket can be pressed onto the horizontal bar before the grout has hardened. After the hardening structure is cured, fencing posts are attached to a column connection portion of the W-anchor that extends from the top of the wall.

12 Claims, 5 Drawing Sheets

U.S. PATENT DOCUMENTS 5,067,292 A * 11/1991 Finean ..... 52/235
5,150,553 A * 9/1992 Commins et al. ..... 52/264
5,442,887 A * 8/1995 Welsh ..... 52/92.2
5,467,569 A * 11/1995 Chiodo ..... 52/713
5,575,130 A * 11/1996 Chiodo ..... 52/713
5,595,031 A * 1/1997 Commins ..... 52/264
5,813,182 A * 9/1998 Commins ..... 52/295
6,560,943 B1 * 5/2003 Leek et al. ..... 52/715
6,658,806 B1 * 12/2003 Leek ..... 52/295
6,964,139 B2 * 11/2005 Meyer et al. ..... 52/299
7,254,919 B2 * 8/2007 Lutz et al. ..... 52/92.2
7,448,171 B1 * 11/2008 diGirolamo et al. ..... 52/92.2
7,506,479 B2 * 3/2009 Pryor ..... 52/293.3
2003/0230039 A1 * 12/2003 Rizzotto ..... 52/295
2005/0011157 A1 * 1/2005 Lutz et al. ..... 52/698
2006/0186391 A1 * 8/2006 Hansen ..... 256/24
2006/0201087 A1 * 9/2006 Cutforth ..... 52/296
2008/0120931 A1 * 5/2008 Joslyn ..... 52/293.3
2008/0213050 A1 * 9/2008 D'Andreta et al. ..... 405/302.6

* cited by examiner

NON-TOP SUPPORTED FENCE INSTALLATION BRACKET

FIELD OF THE INVENTION

The invention relates generally to fence support elements. More particularly, the invention relates to an attachment bracket for connecting fences to cinderblock and/or concrete walls.

BACKGROUND

Wall contractors often encounter construction designs having fences attached to masonry walls such as concrete masonry unit (CMU) walls or cast in place (CIP) walls. In such walls, there is typically a horizontal reinforcing bar along the top inner portion of the masonry wall to provide added strength to the structure. A connective interface is required to attach fence posts to the top portion of the masonry wall, where the fence is then connected to the posts. Currently, angle irons, or U-shaped brackets are used to attach the posts of the fence. For example, when using U-shaped brackets to attach wooden fence posts, the bracket base is immersed in unhardened grout poured in the wall top portion, and the fence post is connected to bracket flanges positioned above the wall top after the grout has hardened. Problems exist with such brackets that can limit the ability of bracket to support a wood fence when exposed to external forces such as wind. A contractor often must determine a way to insert the bracket during or prior to adding high-strength grout without interfering with the reinforcing bar. The contractor is left with options such as splicing the bar to insert the bracket, skewing the bar off center around the bracket, or eliminating the reinforcing bar altogether. In each of these options, the strength of the structure is compromised such that the bracket cannot be certified to be reliable when subject to forces such as wind. Further, the issues raised by interference between the reinforcing bar and the bracket can be lengthy and expensive, where excessive man-hours are required to resolve the interference issues when eliminating the bar is not an option. Accordingly, there is a need to develop a bracket that overcomes the current shortcomings in the art related to connecting a fence post to the top of a masonry wall without interfering with the horizontal reinforcing bar, while providing needed strength.

SUMMARY OF THE INVENTION

The current invention provides a connection to masonry walls for non-top supported fences, where the connection engages a horizontal reinforcing bar imbedded in high-strength grout of the masonry wall and attaches to the column (or post) of the fence. In one embodiment of the invention, a non-top-supported column attachment bracket assembly includes a column base attachment W-anchor, where the W-anchor has an integration portion, and a column connection portion. The integration portion includes a rod receiving feature, and the column connection portion includes column connection holes disposed through the column connection portion. The assembly can further include a cover plate having column connection portion engagement features. The integration portion is disposed into a hardening structure in a wall. The rod receiving feature of the W-anchor engages a horizontal reinforcing rod disposed in the top portion of the wall. The cover plate receives the connection portion with the connection portion engagement features and the plate is disposed over the integration portion. After the hardening structure cures, a column is attached to the connection portion by fastening elements inserted through the connection through-holes.

In one aspect of the invention, the wall is a concrete masonry unit (CMU) wall.

In another aspect of the invention, the wall is a cast-in-place (CIP) wall.

According to a further aspect of the invention, the integration portion is generally W-shaped.

In a further aspect, the integration portion is a generally concave shape.

According to another aspect of the invention, the rod receiving feature passively engages the rod.

In a further aspect of the invention, the rod receiving feature connectively engages the rod. Here, the connective engagement can be a friction fit between the engagement feature and the rod.

In a further aspect, the column base W-anchor can be a formed continuous strap.

In yet another aspect of the invention, the column base W-anchor can be a combined mirror-pair of formed straps. Here, combining the mirror-pair can be accomplished by welding or the like.

In a further aspect, the cover plate connection portion engagement features include slotted holes disposed through the cover plate. Here, the connection portion can further have index flaps disposed to allow the cover plate to be index-positioned.

In yet another aspect of the invention, the cover plate connection portion engagement features can include tabs extending from the plate, where the connection portion further has tab slots for receiving the tabs.

Another embodiment of the invention includes a method of using a non-top-supported column attachment bracket assembly. The method includes the steps of providing a wall having a top portion of the wall, providing a horizontal reinforcing bar along the top portion of the wall, providing a hardening structure to the wall, and providing a column base attachment bracket. Here, the bracket is a W-anchor having an integration portion and a column connection portion with attachment holes disposed there through. The integration portion has a rod receiving feature. The method further includes providing a cover plate having connection portion engagement features, inserting the integration portion to the hardening structure, engaging the rod receiving feature to the horizontal reinforcing rod disposed in the wall, assembling the cover plate to the connection portion using the attachment engagement features, where the plate is disposed over the integration portion, and attaching a column to the connection portion. In one aspect of the method, the wall can be a CMU wall. In another aspect the wall can be a CIP wall.

BRIEF DESCRIPTION OF THE FIGURES

The objectives and advantages of the present invention will be understood by reading the following detailed description in conjunction with the drawing, in which.

DETAILED DESCRIPTION OF THE INVENTION

Although the following detailed description contains many specifics for the purposes of illustration, anyone of ordinary skill in the art will readily appreciate that many variations and alterations to the following exemplary details are within the scope of the invention. Accordingly, the following preferred embodiment of the invention is set forth without any loss of generality to, and without imposing limitations upon, the claimed invention.

The current invention includes a generally W-shaped bracket that provides a strong connection between non-top supported wood fences and masonry walls such as concrete masonry unit (CMU) walls or cast in place (CIP) walls. The W-shape provides a matrix inside the hardening structure of the wall, while simultaneously engaging the horizontal reinforcing bar of the wall. The reinforcing bar can be a continuous length of rebar placed in the upper portion of the wall along the wall centerline to provide enhanced wall-strength by distributing loads on the bracket across the wall. The W-shaped bracket can be installed to the upper portion of the wall just prior to grouting or during grouting, where the bracket can be pressed onto the horizontal bar before the grout has hardened.

Figure 1:
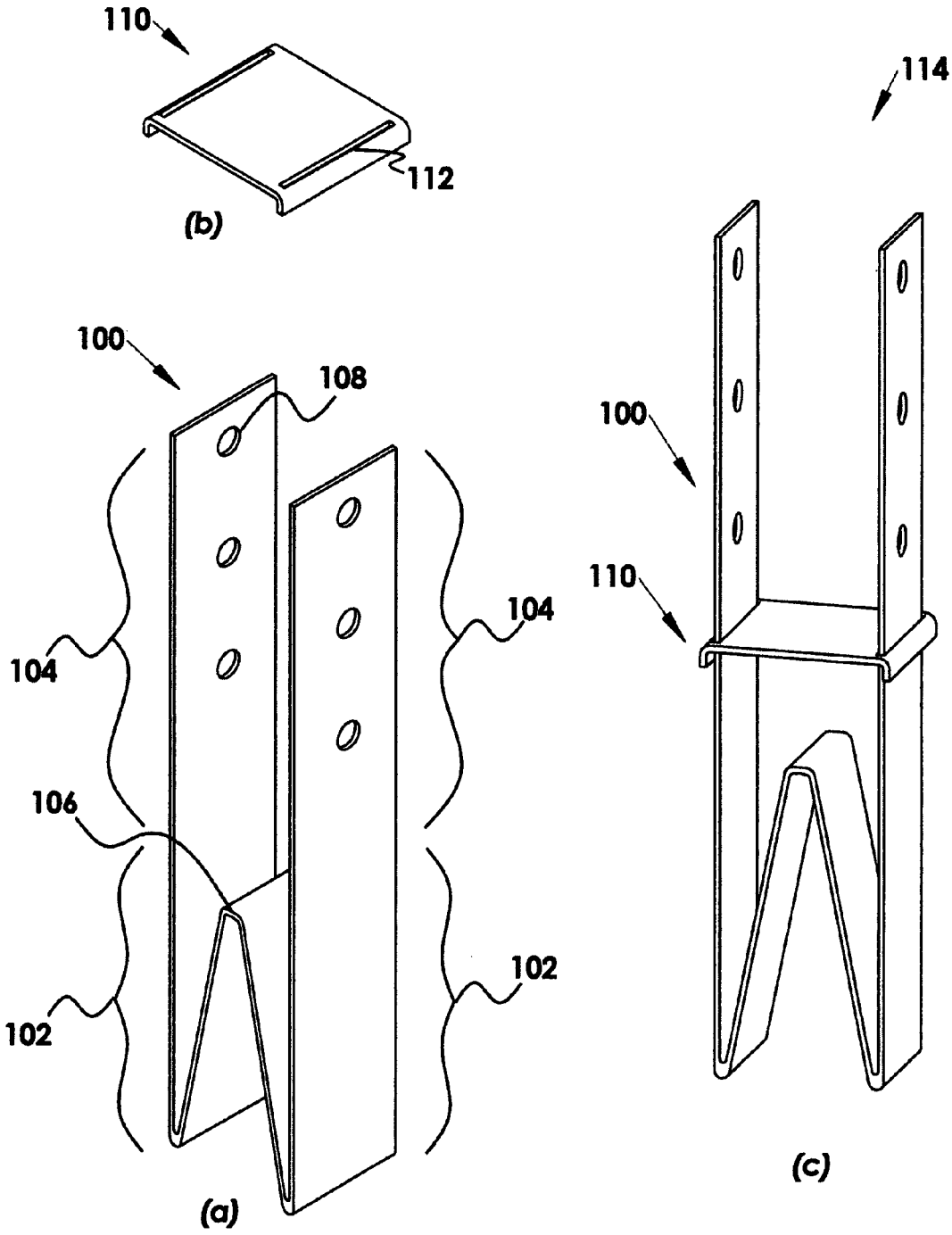
FIGS. 1*a*-1*c* show perspective views of the W-anchor and cap elements, and the non-top-supported column attachment bracket assembly, respectively according to the present invention.
Figure 4:
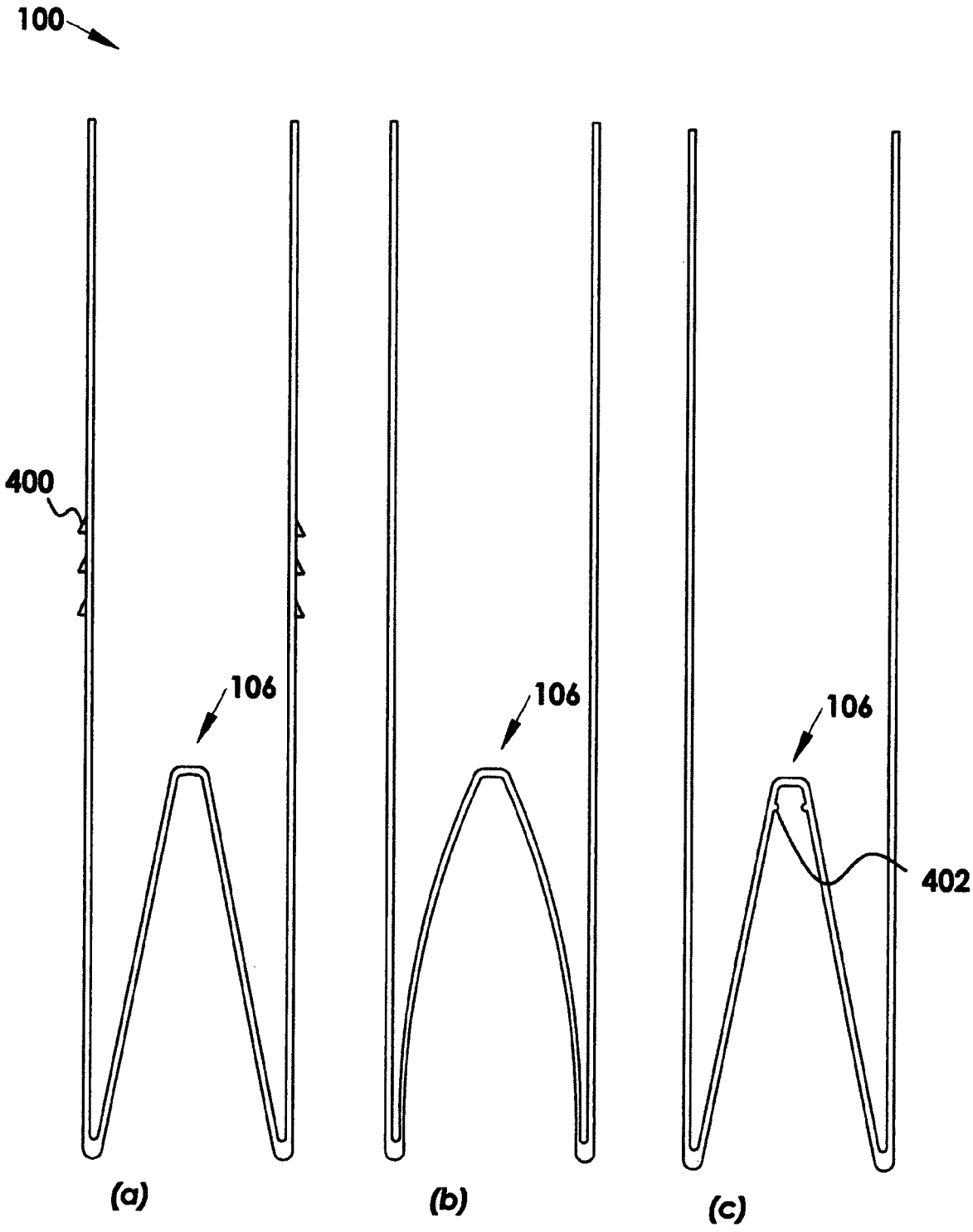
FIGS. 4*a*-4*c* show planar views of different W-anchor embodiments according to the present invention.
Figure 5:
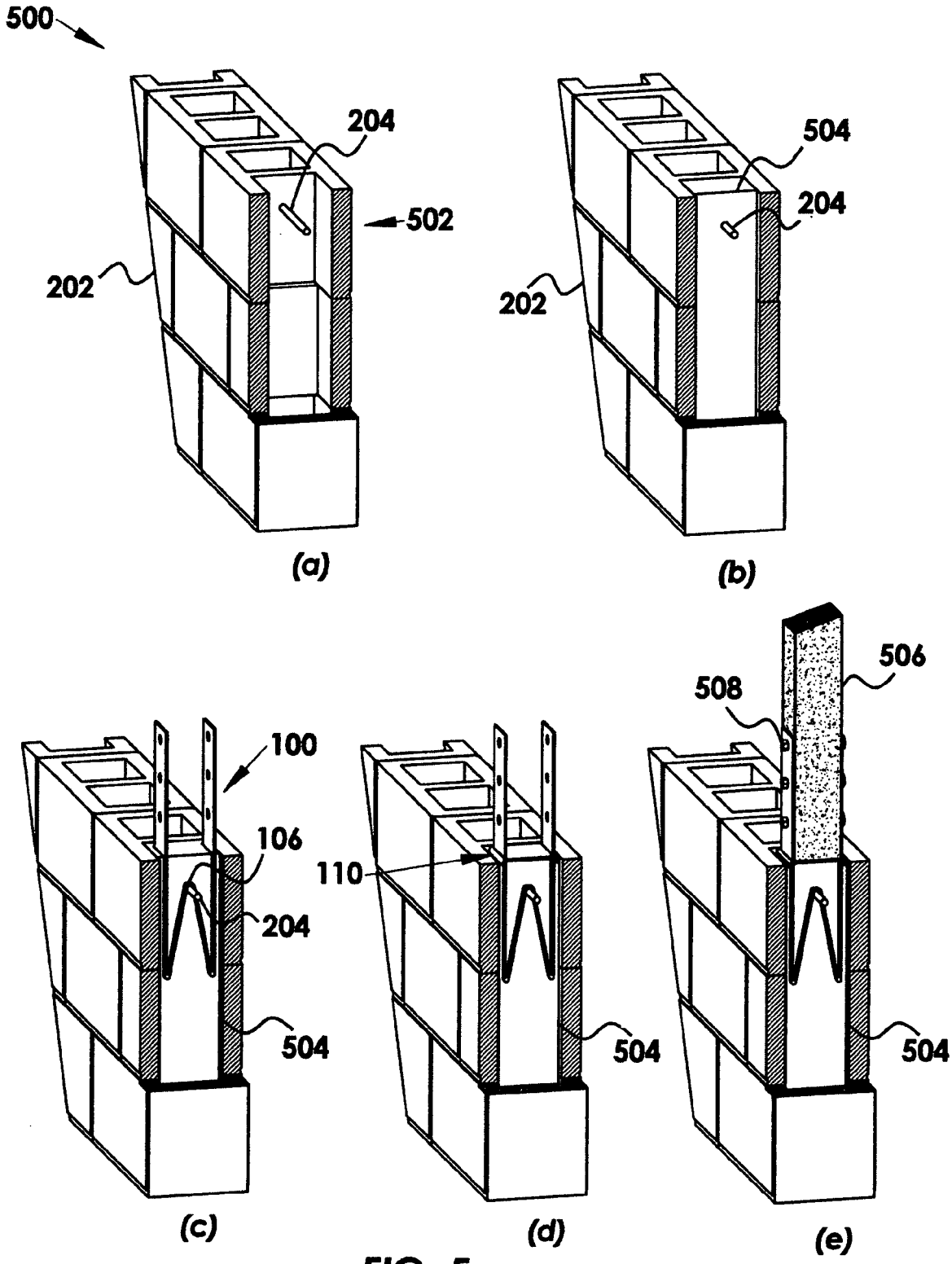
FIGS. 5*a*-5*e* show perspective cutaway views of the steps for using the non-top-supported column attachment bracket assembly with a CMU wall according to the present invention.

Referring to the figures, FIGS. 1*a*-1*c* show perspective views of the bracket or W-anchor and cap elements and the non-top-supported column attachment bracket assembly, respectively. Shown in FIG. 1*a* is W-anchor 100, where the W-anchor 100 has an integration portion 102, and a column connection portion 104. The integration portion 102 includes a rod receiving feature 106, and the column connection portion 104 has column connection holes 108 disposed there through. As shown, the integration portion 102 is generally W-shaped, however the center peak of the W-shape can be any generally concave shape (see FIG. 4). FIG. 1*b* shows an optional cover plate 110 having column connection portion engagement features 112. When implemented, the integration portion 102 is disposed into a hardening structure in a wall (see FIG. 5), where the rod receiving feature 106 engages a horizontal reinforcing rod disposed in the top portion of the wall (see FIGS. 2 and 5). FIG. 1*c* shows a non-top-supported column attachment bracket assembly 114, where the cover plate 110 receives the connection portion 104 with the connection portion engagement features 112, and the plate 110 is disposed over the integration portion 102. A column is attached to the connection portion 104 by fastening elements inserted through the connection through-holes 108 (see FIG. According to one embodiment of the invention, the W-anchor 100 can be formed from a continuous strap using bending methods. According to another embodiment of the invention, the bracket 100 can be made from a combined mirror-pair of formed straps, where the straps are connected, using welding for example, near the rod engagement portion 106.

Figure 2:
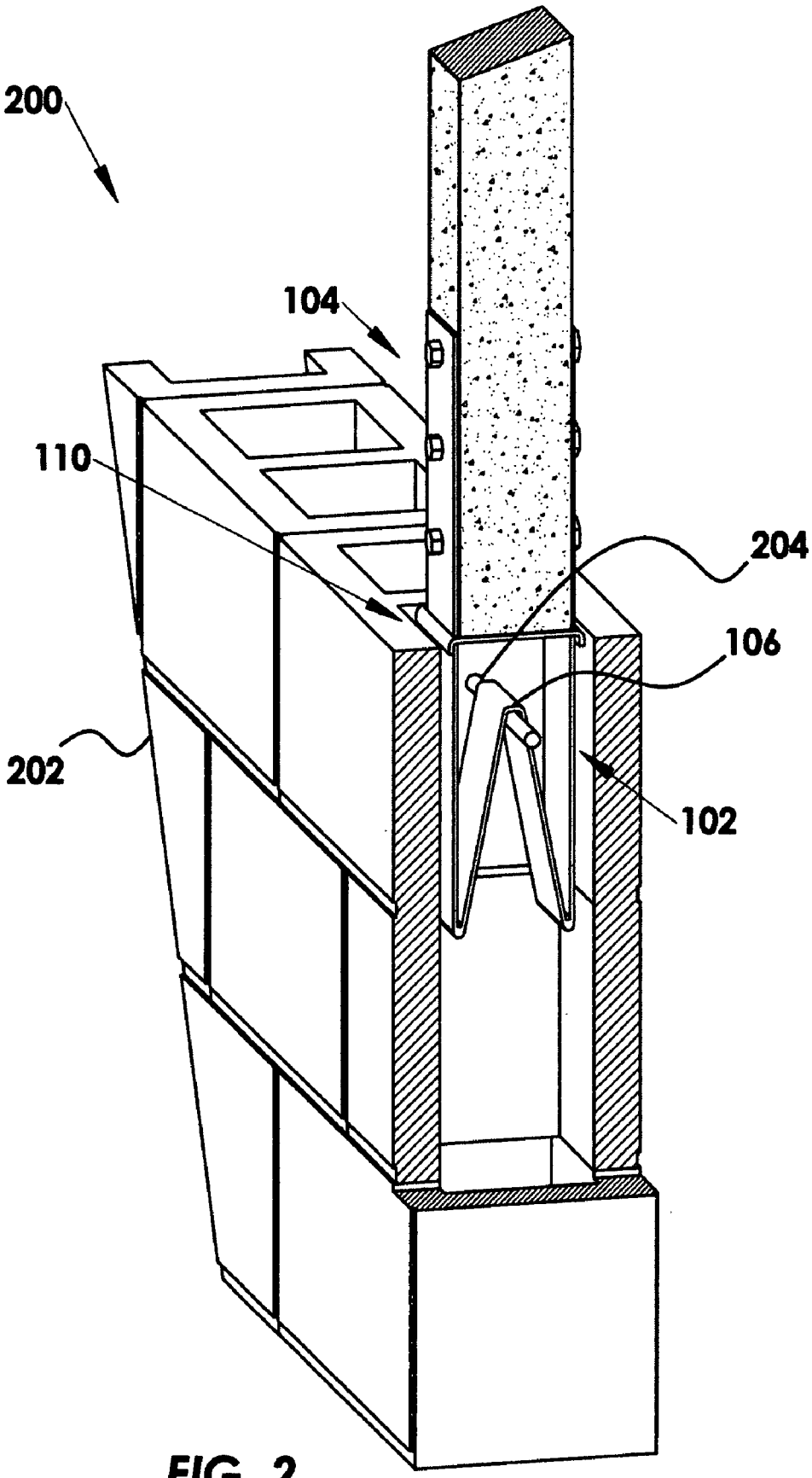
FIG. 2 shows a perspective cutaway view of the non-top-supported column attachment bracket assembly installed to a CMU wall according to the present invention.

FIG. 2 Shows a perspective cutaway view of an installed non-top-supported column attachment bracket and wall assembly 200. In the figure, the hardening structure is not shown so as to better illustrate the aspects of the current invention. As shown, a CMU wall 202 has a reinforcing bar 204 positioned horizontally across the top portion of the CMU wall 202 that is used to provide added strength to the top portion of the wall 202. It is understood that the wall can be a CMU wall or a CIP wall. The rod 204 is received by the rod receiving feature 106 of the W-anchor 100 to provide a self indexing property that sets the column connection portion 104 of the W-anchor 100 at a constant height above the top of the wall 202 according to the position of the reinforcing bar 204. The cover plate 110 is assembled to the column connection portion 104 of the W-anchor 100. Here, the rod receiving feature 106 is shown as passively engaging the rod 204 by simply resting on the rod 204.

Figure 3:
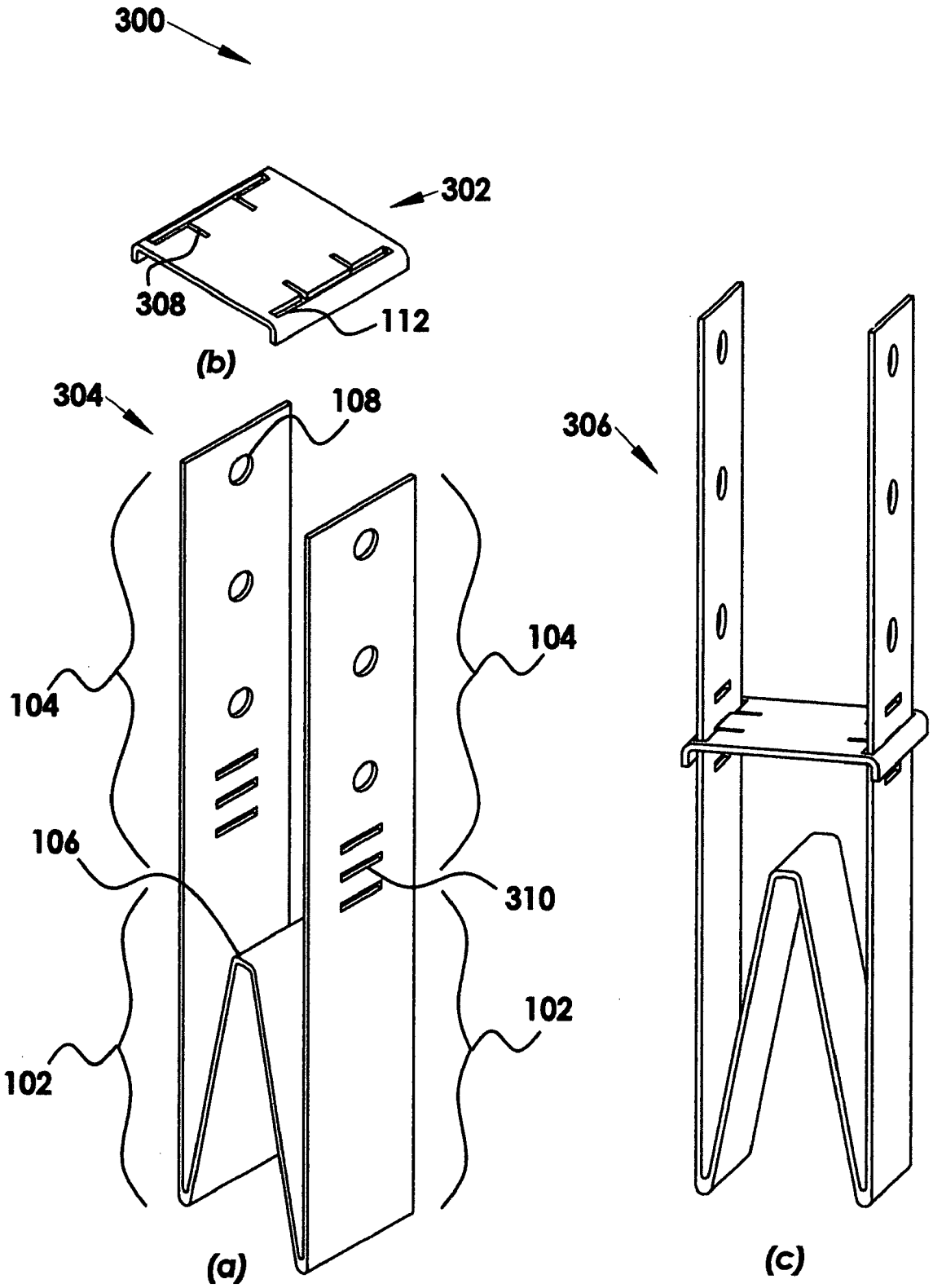
FIGS. 3*a*-3*c* show perspective views of the index pair W-anchor and cap embodiments and the index non-top-supported column attachment bracket assembly embodiment, respectively according to the present invention.

FIGS. 3*a*-3*c* show perspective views of an index pair 300 of an index cap 302 and index W-anchor 304, and the index W-anchor embodiment assembly 306. As shown, the cover plate connection portion engagement features 112 of FIG. 1 have slotted holes disposed through the cover plate in addition to index tabs 308 disposed to allow the index cover plate 302 to be index-positioned along the index W-anchor 304. The tabs 308 extending from the index cover plate 302, where the connection portion 104 of the index bracket 304 has tab slots 310 for receiving the tabs 308, as shown in FIG. 3*c*. The index configuration may also be accomplished by extending tabs from the column connection portion 104 to index with the engagement features 112 of the cap 110 (see FIGS. 1(*b*) and 4(*a*)).

FIGS. 4*a*-4*c* show planar views of different W-anchor 100 embodiments according to the present invention. FIG. 4*a* shows the W-anchor 100 having a generally W-shape, where the center lobe of the W-shape is a rod receiving feature 106. Further shown are flexible index tabs 400 that engage the cover plate 110 through the engagement features 112, according to one embodiment of the invention. FIG. 4*b* shows the W-anchor 100 having a generally concave shape in the central region. FIG. 4*c* shows a W-anchor 100 with the rod receiving feature 106 having engagement articles 402 that provide connective engagement to the rod 204 (not shown). The connective engagement, according to FIGS. 4*a*-4*c* can be a friction fit or a passive fit between engagement feature 106 and the rod 204.

FIGS. 5*a*-5*e* show perspective cutaway views of a method 500 for using the non-top-supported column attachment bracket assembly 114 with a CMU wall 202 according to the present invention, where it is understood that the CMU wall 202 could alternatively be a CIP wall (not shown). The method of using non-top-supported column attachment bracket assembly 500 includes providing a wall 202 having a wall top portion 502, and providing a horizontal reinforcing bar 204 along the wall top portion 502, as shown in FIG. 5*a*. The method 500 further includes providing a hardening structure 504 to the wall 202, where shown in FIG. 5*b* is the hardening structure in a non-hardened state disposed inside a section of the CMU wall 202 shown in a perspective cutaway view for illustrative purposes. The method 500 includes (see FIG. 5*c*) providing the W-anchor 100 into the non-hardened hardening structure 504, where the W-anchor 100 is shown partially exposed from the hardening structure 504 for illustrative purposes. The W-anchor 100 has an integration portion 102 and a column connection portion 104 where the column connection portion has attachment holes 108 disposed there through. The integration portion 102 has a rod receiving feature 106 to engage the rod 204, either passively or connectively. FIG. 5*d* shows the step of providing a cover plate 110, where the cover plate 110 has connection portion engagement features 112. The optional cover plate 110 is assembled to the connection portion 104 using the attachment engagement features 112, where the plate 112 is disposed over the integration portion 102. Finally, after the hardening structure 504 is cured, FIG. 5*e* shows the attachment of a column 506 to the connection portion 104 using attachment hardware 508. According to different embodiments of the method 500 of using the W-anchor assembly, the wall can be a CMU wall 202 or a CIP wall (not shown), and the non-top-supported column attachment bracket assembly 114 can be the index pair 300.

The present invention has now been described in accordance with several exemplary embodiments, which are intended to be illustrative in all aspects, rather than restrictive. Thus, the present invention is capable of many variations in detailed implementation, which may be derived from the description contained herein by a person of ordinary skill in the art. For example the rod receiving feature 106 can be of a reduced or tapered width that is more narrow than the column connection portion 104, where such configuration reduces material cost and reduces weight of the W-anchor 100.

All such variations are considered to be within the scope and spirit of the present invention as defined by the following claims and their legal equivalents.

What is claimed:

1. A non-top-supported column attachment bracket assembly comprising:

a. a column connection portion, wherein said connection portion comprises column connection holes disposed there through;

b. an integration portion wherein said integration portion comprises a W-shape having a rod receiving feature comprising a bottom surface of a central peak of said W-shape, wherein said rod receiving feature is disposed to abut a reinforcing rod of a wall when said bracket is inserted into said wall, wherein said column connection portion is disposed at a constant height above said reinforcing rod; and c. a cover plate, wherein said cover plate comprises column connection portion engagement features, wherein said cover plate receives said connection portion with said connection portion engagement features and said plate is disposed at said top of said integration portion.

2. The column attachment bracket assembly of claim 1, wherein said cover plate connection portion engagement features comprise slotted holes disposed through said cover plate.

3. The column attachment bracket assembly of claim 2, wherein said connection portion further comprises index flaps disposed to allow said cover plate to be index-positioned along said connection portion.

4. The column attachment bracket assembly of claim 2, wherein said cover plate connection portion engagement features comprise tabs extending from said plate, whereas said connection portion further comprises tab slots for receiving said tabs.

5. The column attachment bracket assembly of claim 1, wherein said column attachment bracket is disposed to mount a column bottom to a wall top.

6. The column attachment bracket assembly of claim 1, wherein said integration portion is a generally concave shape.

7. The column attachment bracket assembly of claim 1, wherein said rod receiving feature passively engages said rod.

8. The column attachment bracket assembly of claim 1, wherein said rod receiving feature connectively engages said rod.

9. The column attachment bracket assembly of claim 8, wherein said connective engagement comprises a friction fit between said engagement feature and said rod.

10. The column attachment bracket assembly of claim 1, wherein said column base bracket comprises a formed continuous strap.

11. A method of using non-top-supported column attachment bracket assembly comprising the steps of a. providing a wall comprising a top portion of said wall;

b. providing a horizontal reinforcing bar along said top portion of said wall;

c. providing a hardening structure to said wall;

d. providing a column base attachment bracket, wherein said bracket comprises an integration portion, and a column connection portion having attachment holes disposed there through, whereas said integration portion comprises a rod receiving feature;

e. providing a cover plate comprising connection portion engagement features;

f. inserting said integration portion to said hardening structure, wherein said integration portion comprises a W-shape having a rod receiving feature disposed in a central peak of said W-shape;

g. engaging said rod receiving feature to said horizontal reinforcing rod disposed in said wall, wherein said connection portion is disposed at a constant height above said reinforcing rod;

h. assembling said cover plate to said connection portion using said attachment engagement features where said plate is disposed over said integration portion; and i. attaching a column to said connection portion.

12. The column attachment bracket assembly of claim 11, wherein said column attachment bracket is disposed to mount a column bottom to a wall top.

* * * * *